US009651223B2

(12) United States Patent
Yokotani et al.

(10) Patent No.: US 9,651,223 B2
(45) Date of Patent: May 16, 2017

(54) LIGHT-EMITTING APPARATUS WITH FASTENING OF OPTICAL COMPONENT TO PEDESTAL THROUGH LIGHT-EMITTING SUBSTRATE THROUGH-HOLE, ILLUMINATION LIGHT SOURCE HAVING THE SAME, AND LIGHTING APPARATUS HAVING THE SAME

(71) Applicant: PANASONIC INTELLECTUAL PROPERTY MANAGEMENT CO., LTD., Osaka (JP)

(72) Inventors: Ryouji Yokotani, Osaka (JP); Yasuharu Ueno, Osaka (JP); Masashi Sakata, Osaka (JP); Yoshinori Kakuno, Osaka (JP); Yoshio Manabe, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 97 days.

(21) Appl. No.: 14/513,698

(22) Filed: Oct. 14, 2014

(65) Prior Publication Data

US 2015/0109778 A1 Apr. 23, 2015

(30) Foreign Application Priority Data

Oct. 18, 2013 (JP) ..... 2013-217634

(51) Int. Cl.
*F21V 17/12* (2006.01)
*F21V 5/04* (2006.01)
(Continued)

(52) U.S. Cl.
CPC ..... *F21V 17/12* (2013.01); *F21K 9/232* (2016.08); *F21V 5/046* (2013.01); *F21Y 2115/10* (2016.08)

(58) Field of Classification Search
CPC ..... F21K 9/003; F21K 9/0035; F21K 9/004; F21K 9/0045; F21K 9/13; F21K 9/135;
(Continued)

(56) References Cited

U.S. PATENT DOCUMENTS 5,577,860 A * 11/1996 Plank ..... F16B 43/00 403/11
2008/0192462 A1* 8/2008 Steedly ..... F21V 19/0055 362/218
(Continued)

FOREIGN PATENT DOCUMENTS

JP 2006-313717 11/2006
JP 2009-043447 2/2009
(Continued)

OTHER PUBLICATIONS

Machine translation of WO 2012/124572 A1, retrieved Mar. 9, 2016.*

*Primary Examiner* — Anh Mai
*Assistant Examiner* — Steven Horikoshi
(74) *Attorney, Agent, or Firm* — Greenblum & Bernstein, P.L.C.

(57) ABSTRACT

A light-emitting apparatus includes a pedestal, a substrate, an LED, an optical component, and a fastener. The LED is mounted on the substrate, and the substrate includes a first through-hole. The substrate is disposed on the pedestal. The optical component is disposed in the emission direction of light from the LED. The fastener passes through the first through-hole and fastens the optical component to the pedestal. A portion of the pedestal or a portion of the optical component is inserted in the first through-hole.

19 Claims, 10 Drawing Sheets

(51) Int. Cl.
*F21K 9/232* (2016.01)
*F21Y 115/10* (2016.01)

(58) Field of Classification Search
CPC ..... F21K 9/137; F21V 17/005; F21V 17/12; F21V 17/16; F21V 17/164; F21V 17/168; F21V 19/0055
See application file for complete search history.

(56) References Cited

U.S. PATENT DOCUMENTS

2008/0231169 A1* 9/2008 Hata ..... H01B 1/10 313/500
2008/0298060 A1* 12/2008 Ohkawa ..... G02B 3/0056 362/240
2009/0220317 A1* 9/2009 Travers ..... F16B 5/0208 411/81
2011/0013393 A1* 1/2011 Ishio ..... G02B 19/0014 362/235
2011/0019409 A1* 1/2011 Wronski ..... F21V 7/00 362/235
2011/0140136 A1* 6/2011 Daily ..... H01R 12/721 257/89
2011/0210664 A1* 9/2011 Hisayasu ..... F21V 19/0055 315/32
2012/0206673 A1* 8/2012 Ogata ..... G02F 1/133603 349/69
2012/0287632 A1* 11/2012 Takahashi ..... F21K 9/1355 362/235
2013/0148364 A1 6/2013 Osawa
2013/0214666 A1* 8/2013 Leung ..... F21V 13/04 313/46
2013/0215625 A1* 8/2013 Takeuchi ..... F21K 9/135 362/363
2013/0249411 A1 9/2013 Takahashi et al.
2013/0335966 A1 12/2013 Yokota et al.
2014/0177226 A1* 6/2014 Goelz ..... F21V 29/22 362/294

FOREIGN PATENT DOCUMENTS

JP 2009-170126 7/2009
JP 2012-048969 3/2012
JP WO 2012060106 A1 * 5/2012 ..... F21K 9/135
JP 2012-151145 8/2012
JP WO 2012101687 A1 * 8/2012 ..... F21K 9/1355
JP WO 2012124572 A1 * 9/2012 ..... F21K 9/135
JP 2012-209237 10/2012
JP 2013-182891 9/2013
JP 2013-201354 10/2013
WO 2012/140812 10/2012

* cited by examiner

LIGHT-EMITTING APPARATUS WITH FASTENING OF OPTICAL COMPONENT TO PEDESTAL THROUGH LIGHT-EMITTING SUBSTRATE THROUGH-HOLE, ILLUMINATION LIGHT SOURCE HAVING THE SAME, AND LIGHTING APPARATUS HAVING THE SAME

BACKGROUND OF THE INVENTION

1. Field of the Invention

The present disclosure relates to a light-emitting apparatus, an illumination light source including the light-emitting apparatus, and a lighting apparatus.

2. Description of the Related Art

Light-emitting diodes (LEDs) are used as light sources in a variety of products due to their high efficiency and long lifespan. One example of such a product is a lamp that uses LEDs (LED lamp). LED lamps are increasingly being used as an illumination light source in place of conventional fluorescent lamps and incandescent bulbs.

Japanese Unexamined Patent Application Publication No. 2006-313717 discloses a bulb-shaped LED lamp (LED bulb) for use as a substitute for compact fluorescent lamps and incandescent bulbs. Japanese Unexamined Patent Application Publication No. 2009-043447 discloses a straight tube LED lamp for use as a substitute for straight tube fluorescent lamps. LED lamps include an LED module including, for example, a substrate and a plurality of LEDs mounted on the substrate. The LED module is placed on a pedestal inside the LED lamp.

SUMMARY OF THE INVENTION

The light-emitting apparatus according to an embodiment includes a pedestal, a substrate disposed on the pedestal, a plurality of light-emitting elements mounted on the substrate, and an optical component disposed in an emission direction of light from the plurality of light-emitting elements. A through-hole is formed in the substrate, and at least one of a portion of the pedestal and a portion of the optical component is inserted in the through-hole. A fastener passes through the through-hole and fastens the pedestal and the optical component.

This configuration makes it possible to align the light-emitting element optical components in their relative positions.

DETAILED DESCRIPTION OF THE PREFERRED EMBODIMENT

Figure 1:
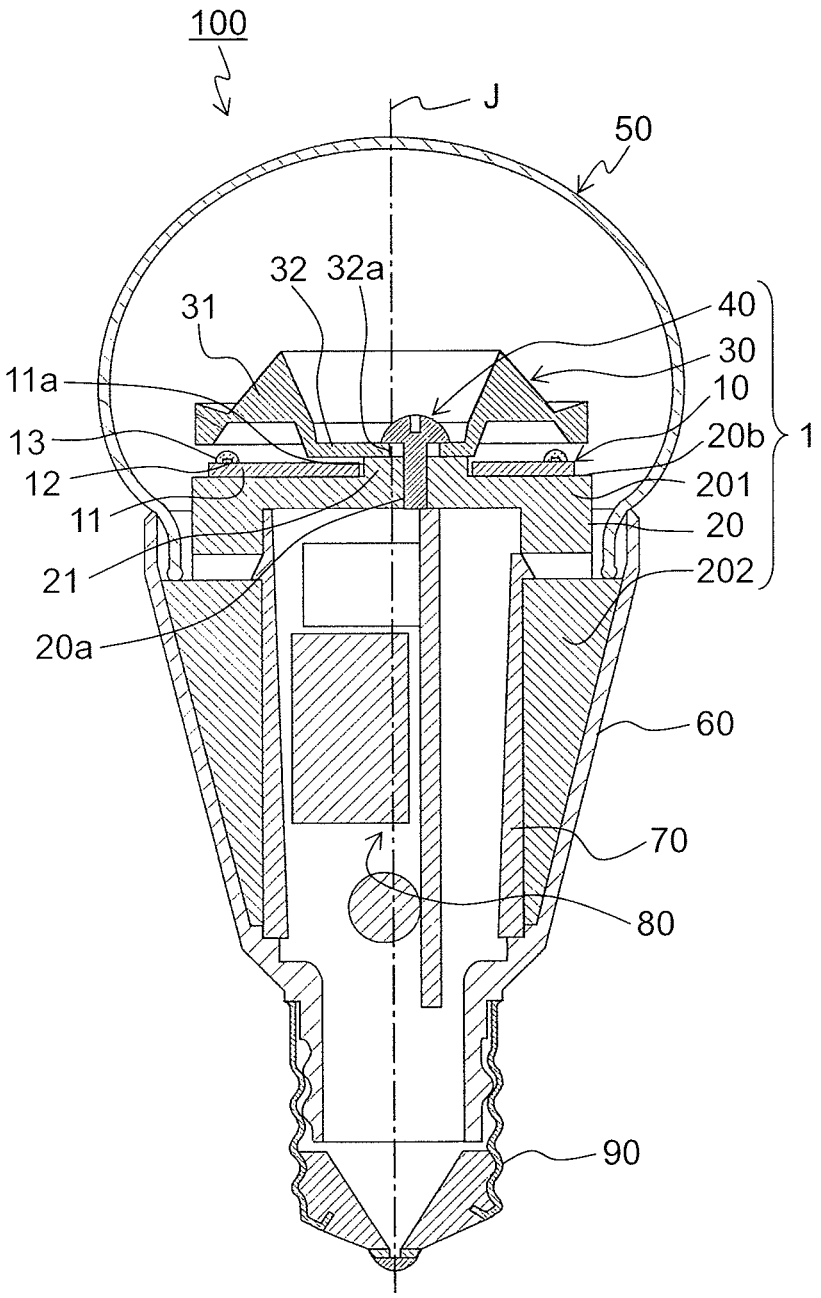
FIG. 1 is a cross sectional view of an illumination light source according to an embodiment.

Before the description of an embodiment, a problem with a conventional light-emitting apparatus will be described. With an LED lamp, an optical component (for example, a light distribution controlling lens) is disposed in the emission direction of light from an LED module to control the distribution of light emitting from the LED module. Multiple methods for disposing and fixing the optical component are conceivable.

For example, a method in which the optical component is fixed to the substrate (module substrate) of the LED module is conceivable. However, with this method, since load is applied to the module substrate, there is concern that the module substrate will break. When a screw is used as a fastening means, the clamping force of the screw can break the module substrate. For example, when a ceramic substrate is used as the module substrate, the substrate can easily chip or break.

Moreover, a method in which the optical component is fixed to a pedestal on which the module substrate is placed is also conceivable. However, with this method, it is difficult to accurately align the LED module (LEDs) and the optical component. In other words, it is difficult to align the optical component, pedestal, and module substrate in their relative positions.

If the LED module (LEDs) and the optical component are not aligned in their relative positions as designed, the optical axis of the LED module and the optical axis of the optical component become misaligned, making it impossible to obtain a desired light distribution characteristic.

Hereinafter, an embodiment is described with reference to the drawings. The embodiment described below is representative of a preferred example. The numerical values, shapes, materials, constituent elements, the arrangement and connection of the constituent elements, steps (processes), and order of the steps are mere examples.

It should be noted that the respective drawings are schematic diagrams and are not necessarily precise illustrations. Additionally, components that are essentially the same share the same reference numerals in the respective drawings, and overlapping explanations of these components are omitted or simplified.

(Light-Emitting Apparatus and Illumination Light Source)

Figure 2A:
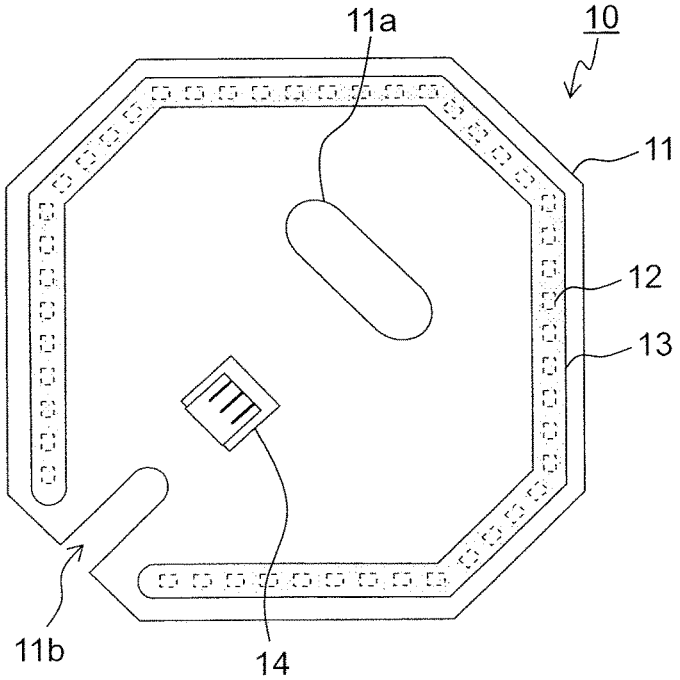
FIG. 2A is a plan view of an LED module according to the embodiment.
Figure 2B:
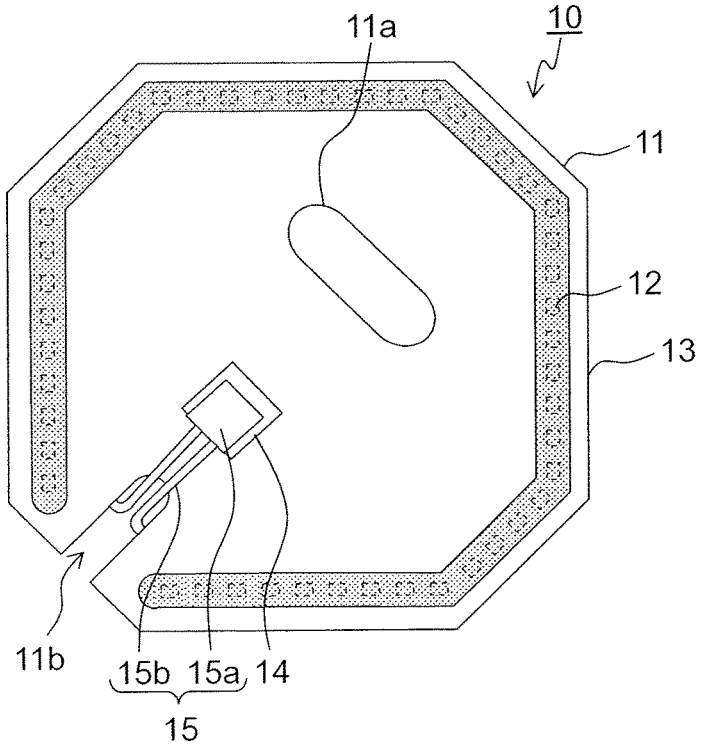
FIG. 2B is a plan view of the LED module illustrated in FIG. 2A when LED module is connected with a lead wire.
Figure 3:
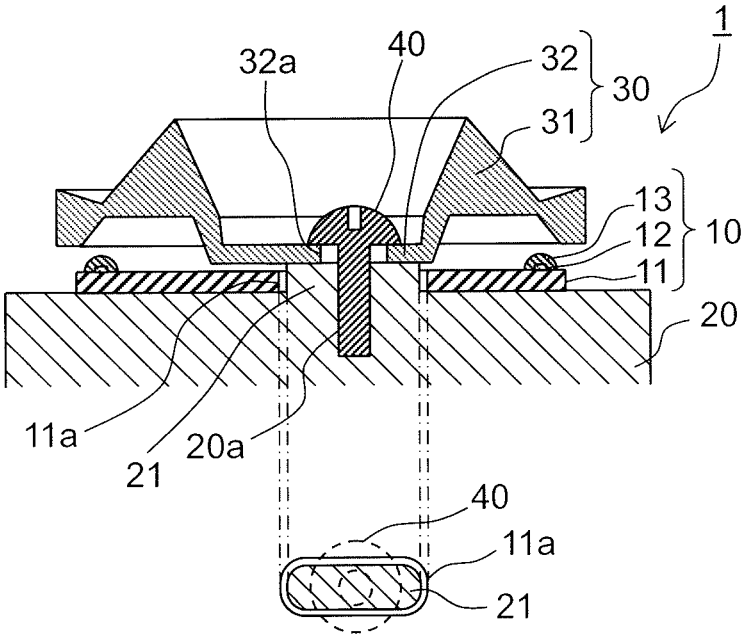
FIG. 3 is a cross sectional view of a light-emitting apparatus according to the embodiment.

First, the general structures of light-emitting apparatus 1 and illumination light source 100 according to an embodiment will be described with reference to FIG. 1 through FIG. 3. FIG. 1 is a cross sectional view of illumination light source 100. FIG. 2A is a plan view of LED module 10 included in light-emitting apparatus 1. FIG. 2B is a plan view of LED module 10 when LED module 10 is connected with a lead wire. FIG. 3 is a cross sectional view of light-emitting apparatus 1. It should be noted that the vertical dashed and dotted line in FIG. 1 indicates optical axis J (lamp axis) of illumination light source 100. Optical axis J aligns with the central axis of each of optical LED module 10, optical component 30, and globe 50. Optical axis J is also the axis of rotation around which illumination light source 100 rotates upon attachment to a lighting fixture (not shown in the drawings) socket. Optical axis J also aligns with the axis of rotation of base 90.

The light-emitting apparatus 1 is an LED light source apparatus that uses LEDs as a light source. Light-emitting apparatus 1 includes LED module 10, pedestal 20 on which LED module 10 is disposed, optical component 30 disposed in the emission direction of light from LED module 10, and fastener 40 for fastening pedestal 20 and optical component 30 together. Through-hole 11*a* is formed in LED module 10. LED module 10 includes substrate 11 disposed on pedestal 20 and a plurality of light-emitting elements (LEDs) 12 mounted on substrate 11. Fastener 40 passes through through-hole 11*a* and fastens pedestal 20 and optical component 30 together, thereby securing substrate 11 in place. At least one of a portion of pedestal 20 and a portion of optical component 30 is inserted in through-hole 11*a*.

Illumination light source 100 is a bulb-shaped LED lamp (LED bulb) used as a substitute for compact fluorescent lamps or incandescent bulbs, and includes light-emitting apparatus 1. More specifically, illumination light source 100 includes light-emitting apparatus 1, globe 50, housing 60, circuit case 70, drive circuit 80, and base 90. Light-emitting apparatus 1 includes LED module 10, pedestal 20, optical component 30, and fastener 40. Housing 60 is a tubular component. Light-emitting apparatus 1 is disposed at a first end of tubular housing 60. Base 90 is disposed at the second end of housing 60. Globe 50 closes the first end of housing 60. Drive circuit 80 is housed in housing 60. The external enclosure of illumination light source 100 consists of globe 50, housing 60, and base 90.

Hereinafter, each component of illumination light source 100, including light-emitting apparatus 1, will be described in detail.

[LED Module]

LED module 10 is a light-emitting module that emits light of a certain color (wavelength), such as white light. As is illustrated in FIG. 1, LED module 10 is placed on pedestal 20 and emits light using power supplied from drive circuit 80. LED module 10 is arranged in globe 50 so as to be covered by globe 50.

As is illustrated in FIG. 2A, LED module 10 includes substrate 11, a plurality of LEDs 12 mounted on substrate 11, sealing member 13 that seals LEDs 12, and power supplier 14 that supplies power to LEDs 12.

It should be noted that LED module 10 further includes metal lines (not shown in the drawings) patterned in a predetermined pattern on substrate 11, wire (not shown in the drawings) electrically connecting LEDs 12 together, and a protective element (not shown in the drawings) that electrostatically protects LEDs 12, such as a zener diode. LED module 10 has a chip-on-board (COB) structure in which LEDs 12, which are bare chips, are mounted directly on substrate 11.

[Substrate]

As is illustrated in FIG. 3, substrate 11 is disposed on pedestal 20. More specifically, substrate 11 is placed on and fixed to pedestal 20. Substrate 11 is fixed to pedestal 20 with, for example, an adhesive such as silicon resin.

LEDs 12 are mounted on substrate 11. A ceramic substrate, resin substrate, glass substrate, or a metal substrate having a main surface coated with an insulating film may be used as substrate 11.

The ceramic substrate is, for example, a polycrystalline-ceramic substrate made of, for example, sintered aluminum oxide (alumina) or aluminum nitride. The resin substrate is, for example, a glass epoxy substrate or a flexible substrate made of, for example, polyimide. The metal substrate is, for example, an aluminum alloy substrate, an iron alloy substrate, or a copper alloy substrate.

A white substrate having high optical reflectivity is preferably used as substrate 11. Using a white substrate makes it possible to reflect at least 90% of the light from LEDs 12 off the surface of substrate 11. This improves the light extraction efficiency of light-emitting apparatus 1. A white ceramic substrate made of alumina (white alumina substrate) is used as substrate 11. A ceramic substrate has a higher rate of heat transfer than a resin substrate, and can efficiently disperse out heat generated by LEDs 12. Moreover, ceramic substrates have a low time degradation and excel in terms of heat tolerance.

As is illustrated in FIG. 2A, substrate 11 has, for example, an octagonal shape in a plan view. It should be noted that the shape of substrate 11 in a plan view is not limited to an octagonal shape. Substrate 11 may have a quadrilateral shape such as a rectangular or square shape, or a polygonal shape other than an octagonal shape such as a hexagonal shape, or a circular or other shape.

Substrate 11 has first through-hole 11*a* and second through-hole 11*b*. When substrate 11 is a ceramic substrate, first through-hole 11*a* and second through-hole 11*b* can be cut with a laser.

First through-hole 11*a* is formed inside the loop formed by LEDs 12 and sealing member 13. In other words, first through-hole 11*a* is formed in the region surrounded by the light emitter (LEDs 12 and sealing member 13) of LED module 10.

Fastener 40 is inserted in first through-hole 11*a*. A portion of pedestal 20 is also inserted in first through-hole 11*a*. More specifically, raised portion 21, which is a portion of pedestal 20, is inserted in first through-hole 11*a*. It should be noted that first through-hole 11*a* is formed in the region surrounded by sealing member 13 (inner region).

First through-hole 11*a* has an oval-shaped (racetrack-shaped) opening. It should be noted that the shape of first through-hole 11*a* is not limited to this example. For example, first through-hole 11*a* may have a perfect circle or polygonal shape.

Lead wire 15 connected to power supplier 14 is inserted in second through-hole 11*b*. In other words, second through-hole 11*b* is provided for conveying lead wire 15.

Second through-hole 11*b* is a slit formed by notching an edge of substrate 11. Second through-hole 11*b*, which is a notched slit, is a recess formed so as to retreat toward the center of the substrate from one edge of the octagonal substrate 11. Moreover, second through-hole 11*b* is formed so as to penetrate substrate 11 from one main surface to the other.

It should be noted that second through-hole 11*b* is not limited to a notched slit, and may be a through-hole like first through-hole 11*a*. In this case, sealing member 13 can be formed as a continuous loop without an opening.

[LED]

As is illustrated in FIG. 2A, LEDs 12 are disposed in a loop shape on the main surface of substrate 11. LEDs 12 are mounted in a loop shape around the outer perimeter of substrate 11 such that the shape of the loop corresponds with the shape of substrate 11. More specifically, LEDs 12 on substrate 11 are arranged in a single line that forms an octagonal shape.

LEDs 12 are one example of the light-emitting elements, and are semiconductor light-emitting elements that emit light using predetermined electrical power. LEDs 12 are blue bare chip LEDs that emit blue light when electricity passes through them. A gallium nitride semiconductor light-emitting element, for example, that is made of InGaN and emits light having a central wavelength between 440 nm and 470 nm inclusive may be used as the blue LED.

LEDs 12 are directly connected to each other by wire. In other words, two adjacent ones of LEDs 12 are connected by chip-to-chip wire bonding, wherein the cathode of one of the two adjacent ones of LEDs 12 is connected by wire to the anode of the other of the two adjacent ones of LED 12.

[Sealing Member]

As is illustrated in FIG. 2A, sealing member 13 collectively seals the plurality of LEDs 12 mounted in a loop shape, and has a shape corresponding to the shape in which LEDs 12 are arranged. Since LEDs 12 are arranged in a single line that forms an octagonal shape on substrate 11, sealing member 13 is formed in an octagonal shape corresponding to the single line of LEDs 12.

Sealing member 13 can be made of a resin material having light-transmitting properties, for example. When the wavelength of the light emitted by LEDs 12 is to be transformed to a predetermined wavelength, a wavelength transforming material may be included in sealing member 13. In this case, sealing member 13 is a wavelength transforming member. This kind of sealing member 13 can be configured from a resin material having insulating properties and including phosphor particles (phosphor-containing resin). The phosphor particles are excited by the light emitted from LEDs 12 and radiate light of a desired color (wavelength).

For example, silicon resin may be used as the resin material for sealing member 13. Moreover, sealing member 13 may be dispersed with a light diffusing material such as silica. It should be noted that sealing member 13 is not required to be made from resin, and may be made from an organic material such as a fluorocarbon polymer, or a non-organic material such as low-melting glass or sol-gel glass.

Moreover, when, for example blue LEDs which emit a blue light are used as LEDs 12, YAG yellow phosphor particles, for example, can be used as the phosphor particles contained in sealing member 13 in order to yield a white light. With this, a portion of the blue light emitted from LEDs 12 is wavelength-transformed into a yellow light by the yellow phosphor particles included in sealing member 13. Then, the blue light not absorbed by the yellow phosphor particles mixes with the yellow light resulting from the wavelength-transformation by the yellow phosphor particles so that the light emitted from sealing member 13 is white.

Sealing member 13 can be formed by applying a phosphor-containing resin in a line on substrate 11 so as to cover LEDs 12 using a dispenser and then hardening the resin.

Moreover, since second through-hole 11*b* is formed as a notched slit in substrate 11, sealing member 13 has two ends where the loop shape is broken by second through-hole 11*b*. The top and side surfaces of the ends of sealing member 13 have a curved profile, and as such, light also exits from these ends parallel to the substrate. With this, light is not interrupted by second through-hole 11*b*, whereby light is emitted from LED module 10 in a loop shape. By forming the two ends of sealing member 13 to line up across second through-hole 11*b*, it is possible to reduce the interruption of light by second through-hole 11*b*.

Moreover, by using a white ceramic substrate as substrate 11, the light exiting the ends of sealing member 13 can easily be reflected off the inner surface of second through-hole 11*b* (notched slit), making it possible to even further reduce the interruption of light by second through-hole 11*b*.

It should be noted that in order to increase the distance between power supplier 14 and second through-hole 11*b*, power supplier 14 may be disposed away from second through-hole 11*b*. For example, second through-hole 11*b* may be disposed in a position removed from the center of substrate 11. As is illustrated in FIG. 2B, lead wire 15 connected to power supplier 14 is bent after it is introduced through second through-hole 11*b*. By distancing power supplier 14 from second through-hole 11*b*, it is possible to reduce the stress load placed on lead wire 15 by the bend. As such, it is possible to keep power supplier 14 from separating from substrate 11, keep lead wire 15 from separating from power supplier 14, and keep a portion of lead wire 15 from breaking. Moreover, distancing power supplier 14 from second through-hole 11*b* makes it easier to connect lead wire 15, thereby improving workability.

[Power Supplier]

Power supplier 14 (power supply terminal) is an external connecting terminal for receiving predetermined electricity from a source exterior to light-emitting apparatus 1. Power supplier 14, for example, receives DC electricity for powering LEDs 12, and supplies the received DC electricity to LEDs 12 on substrate 11 via metal lines and wire.

As is illustrated in FIG. 2A, power supplier 14 is a socket connector. More specifically, power supplier 14 includes a resin socket and a plurality of conductive pins (not shown in the drawings) for receiving the DC electricity. The plurality of conductive pins include high voltage conductive pins and low voltage conductive pins, and are electrically connected to metal lines formed on substrate 11.

As is illustrated in FIG. 2B, lead wire 15 fed from drive circuit 80 is connected to power supplier 14. More specifically, power supplier 14 is capable of receiving electricity when connector 15*a* of lead wire 15 is connected to the socket of power supplier 14.

Electricity is supplied to LED module 10 via lead wire 15. For example, lead wire 15 includes connector (socket connector) 15*a* which connects to power supplier 14, and a pair of conductive wires 15*b* connected to connector 15*a*. Connector 15*a* has a shape that allows it to be connectable to the socket of power supplier 14. The pair of conductive wires 15*b* are, for example, vinyl wires configured from a metal core and a resin sleeve.

It should be noted that power supplier 14 is not required to be a socket-type unit; power supplier 14 may be a metal electrode patterned on substrate 11.

[Pedestal]

As is illustrated in FIG. 1 and FIG. 3, pedestal 20 supports LED module 10. As is illustrated in FIG. 1, pedestal 20 is disposed inside illumination light source 100.

Pedestal 20 includes placing surface 20*b* (LED module mounting surface) for placing LED module 10. More specifically, substrate 11 of LED module 10 is placed on the placing surface of pedestal 20.

Pedestal 20 also functions as a heat sink for dissipating heat generated by LED module 10. Consequently, pedestal 20 is preferably made of a metal such as aluminum or a resin having a high rate of heat transfer.

A portion of pedestal 20 is provided as raised portion (boss) 21 protruding toward optical component 30. Raised portion 21 is inserted in first through-hole 11*a* of substrate 11. Raised portion 21 is configured such that the top of raised portion 21 protrudes from first through-hole 11*a* when inserted in first through-hole 11*a*. In other words, the height of raised portion 21 measured from the placing surface of pedestal 20 is greater than the thickness of substrate 11. This makes it possible to provide a gap between opposing surfaces of substrate 11 and optical component 30 when optical component 30 is placed on the top surface (uppermost surface) of raised portion 21. As a result, the surface of optical component 30 across from substrate 11 (the back surface of attachment portion 32) does not come in contact with substrate 11.

Moreover, at least a portion of the side surface of raised portion 21 has a shape corresponding to the inner side surface exposed to first through-hole 11*a* of substrate 11. As is illustrated in FIG. 3, the shape of the top of raised portion 21 is substantially identical to the shape of the opening of first through-hole 11*a*. Moreover, the shape of the side surface of raised portion 21 and the shape of the inner surface of first through-hole 11*a* are substantially identical. In other words, raised portion 21 is shaped so as to mate with first through-hole 11*a*. More specifically, raised portion 21 has an oval (racetrack) shape in a plan view. It should be noted that even when raised portion 21 and first through-hole 11*a* are mated together, a slight gap may be present between raised portion 21 and first through-hole 11*a*.

Pedestal 20 includes fastening hole 20*a* for fastening fastener 40. For example, when fastener 40 is a screw, fastening hole 20*a* is a screw hole having a threaded inner surface into which the screw can be screwed.

Fastening hole 20*a* is formed in the center of raised portion 21, and is in communication with first through-hole 11*a*. Fastening hole 20*a* is, for example, formed by depressing raised portion 21 from the top surface into the interior of pedestal 20.

It should be noted that pedestal 20 may extend to the interior of housing 60. Pedestal 20 includes a substantially circular plate-like placing portion 201 on which LED module 10 is placed and a substantially cylindrical tubular portion 202 surrounded by housing 60. The outer surface of the tubular portion is in contact with the inner surface of housing 60, and the inner surface of the tubular portion is in contact with circuit case 70.

[Fastener]

Fastener 40 is a clamping member such as a screw, and as is illustrated in FIG. 1 and FIG. 3, passes through first through-hole 11*a* of substrate 11 and fastens pedestal 20 and optical component 30 together. Although fastener 40 is a screw, it should be noted that when fastening hole 20*a* of pedestal 20 is a through-hole, a bolt and nut may be used as fastener 40. Fastener 40 may also be a rivet.

Figure 4A:
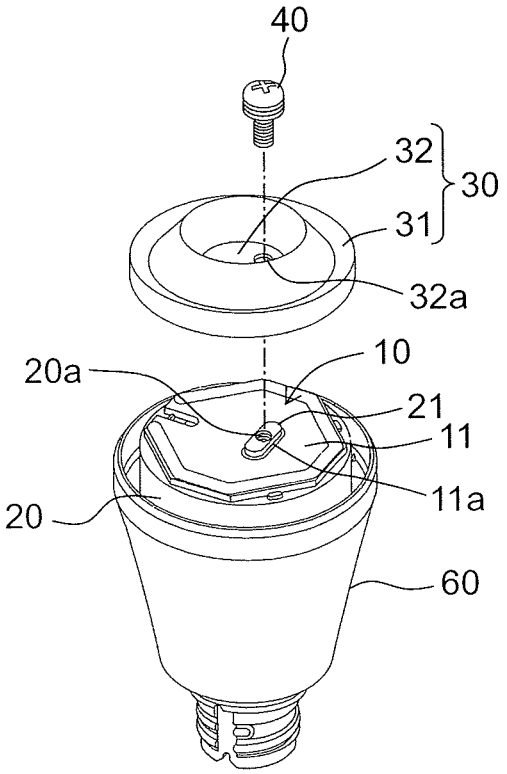
FIG. 4A illustrates a method for fixing a pedestal and an optical component in the light-emitting apparatus illustrated in FIG. 3.
Figure 4B:
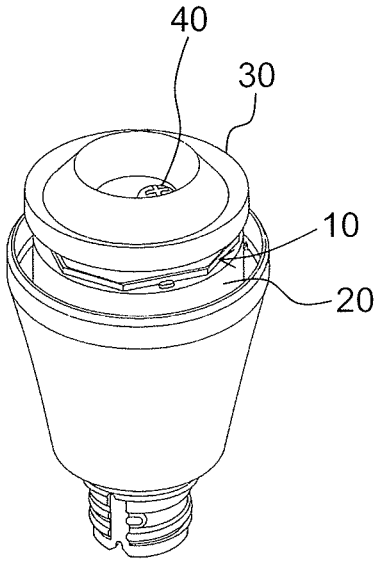
FIG. 4B is a birds-eye view of the pedestal and the optical component illustrated in FIG. 4A in a fixed state.

The method for fixing pedestal 20 and optical component 30 is illustrated in FIG. 4A and FIG. 4B. FIG. 4A illustrates the method for fixing pedestal 20 and optical component 30 in light-emitting apparatus 1. FIG. 4B is a birds-eye view of pedestal 20 and optical component 30 in a fixed state.

First, as is illustrated in FIG. 4A, raised portion 21 of pedestal 20 is inserted in first through-hole 11*a* of substrate 11, and LED module 10 is placed on pedestal 20. At this time, substrate 11 of LED module 10 and pedestal 20 are fixed together with an adhesive. A heat transferring grease or sheet may be used as the adhesive.

Next, as is illustrated in FIG. 4B, optical component 30 is placed on top of raised portion 21 such that the back surface (attachment surface) of attachment portion 32 of optical component 30 is in contact with the top surface of raised portion 21.

Fastener 40 is then inserted in insertion hole 32*a* of optical component 30 and screwed into fastening hole 20*a* of pedestal 20. With this, optical component 30 is fixed to pedestal 20.

It should be noted that after fastener 40 is screwed into fastening hole 20*a*, the head of the screw is in contact with attachment portion 32 of optical component 30, as is illustrated in FIG. 3. Here, attachment portion 32 of optical component 30 is held between the head of the screw (fastener 40) and pedestal 20 (raised portion 21) by the clamping force of the screw.

[Optical Component]

Optical component 30 is a lens (light distribution controlling lens) that controls the distribution of light emitted from the light emitter (LEDs 12 and sealing member 13) of LED module 10, and is, for example, configured from a light-transmitting resin material. A light-transmitting resin material such as poly(methyl methacrylate) (PMMA) or polycarbonate (PC) may be used for optical component 30.

It should be noted that the optical axis of optical component 30 is aligned with the optical axis of LED module 10. Moreover, optical component 30 does not inhibit light emitting from the outer perimeter of LED module 10.

As is illustrated in FIG. 1 and FIG. 3, optical component 30 includes lens portion 31 and attachment portion 32. Lens portion 31 is disposed across from LEDs 12 and attachment portion 32 is attached to pedestal 20. Lens portion 31 and attachment portion 32 can be integrally formed from resin.

Lens portion 31 is shaped so as to realize a desired light distribution of the light emitted from the light emitter of LED module 10. For example, lens portion 31 can increase the light distribution angle of illumination light source 100 by, for example, refracting (such as focusing or diffusing) and reflecting the light from LED module 10.

More specifically, lens portion 31 is capable of transmitting a portion of the light from the light emitter of LED module 10 forward and reflecting the other portion of the light laterally or backward.

Attachment portion 32 is, for example, plate-shaped and in contact with pedestal 20. Optical component 30 is mounted on pedestal 20 such that the bottom surface of attachment portion 32 is in contact with the top surface of raised portion 21 of pedestal 20. It should be noted that attachment portion 32 is not in contact with substrate 11 of LED module 10. In other words, there is a gap of a predetermined size between attachment portion 32 and substrate 11. With this, even when optical component 30 is fastened by fastener 40, optical component 30 does not place a load on substrate 11.

As such, optical component 30 is not in contact with substrate 11 of LED module 10, but depending on the thickness of the adhesive used to bond pedestal 20 to substrate 11, there are instances when optical component 30 (attachment portion 32) is in contact with substrate 11. However, even in this case, since the elasticity of the adhesive absorbs the load placed on substrate 11 by optical component 30, the load on substrate 11 can be reduced.

Moreover, attachment portion 32 includes insertion hole 32*a* through which fastener 40 is inserted. The diameter of the opening of insertion hole 32*a* is, for example, bigger than the diameter of the opening of fastening hole 20*a* of pedestal 20, but smaller than the outer diameter of the head of fastener 40, which is a screw. The central axis of insertion hole 32*a* is aligned with central axis of fastening hole 20*a*.

[Globe]

As is illustrated in FIG. 1, globe 50 is a light-transmitting cover that covers LED module 10 and optical component 30. With globe 50, light directly emitted from LED module 10 or light from LED module 10 after it has passed through optical component 30 is extracted out of the lamp. Light incident on the inner surface of globe 50 passes through globe 50 and is extracted out of globe 50.

Globe 50 is a hemispherical, hollow member having an opening portion. As is illustrated in FIG. 1, globe 50 is, for example, a hollow rotating body whose rotational axis is lamp axis J. The diameter of the opening portion is smaller than the diameter of the hemispherical portion of globe 50.

Globe 50 is held by pedestal 20, and the opening portion is positioned so as to abut the surface of pedestal 20 (tubular portion), thereby closing a first end of housing 60, which is a cylindrical member. The opening portion of globe 50 is fixed to pedestal 20 and the inner surface of housing 60 with an adhesive such as silicon resin.

Globe 50 may be made from a light-transmitting material such as glass like silica glass, or a resin like acryl or polycarbonate.

Moreover, globe 50 may have a light diffusing function. For example, a resin or white pigment including a light diffusing substance such as silica or calcium carbonate may be coated on the entire inner or outer surface of globe 50 to form an opaque white light diffusing film. By providing globe 50 with a light diffusing function in this manner, the light distribution angle of illumination light source 100 can be increased.

It should be noted that globe 50 may be transparent such that LED module 10 inside the globe is visible, without providing globe 50 with a light diffusing function. Moreover, globe 50 is hemispherical, but the shape of globe 50 is not limited to this example. Globe 50 may be a spheroid or an oblate spheroid. For example, a globe shape compliant with a standard A-type bulb may be used.

[Housing]

As is illustrated in FIG. 1, housing 60 forms the outer wall of the lamp, and the outer surface of housing 60 is exposed to the outside (ambient). Housing 60 is, for example, made of an insulating resin material such as polybutylene terephthalate (PBT).

Housing 60 is a tubular component that surrounds the tubular portion of pedestal 20. Moreover, housing 60 includes, on the outer periphery surface, a base attachment portion which includes a threaded portion for screwing on base 90. Base 90 is fixed to housing 60 by screwing onto the base attachment portion.

[Circuit Case]

As is illustrated in FIG. 1, circuit case 70 is an insulating case configured to surround drive circuit 80. Circuit case 70 is, for example, made of an insulating resin material such as polybutylene terephthalate (PBT). The inner surface of circuit case 70 is provided with, for example, a clasp (not shown in the drawings) for latching onto the circuit substrate of drive circuit 80.

Moreover, circuit case 70 is fixed to the interior of the tubular portion of pedestal 20. The outer surface of circuit case 70 is provided with a clasp (not shown in the drawings), and the clasp catches on a hole formed in the tubular portion of pedestal 20 to latch circuit case 70 to pedestal 20.

[Drive Circuit]

As is illustrated in FIG. 1, drive circuit (circuit unit) 80 is a lighting circuit for causing LED module 10 (LEDs 12) to emit light (turn on), and supplies predetermined electricity to LED module 10. Drive circuit 80 is a power source circuit that converts the AC electricity supplied form base 90 via a pair of lead wires (not shown in the drawings) into DC electricity, and supplies the converted DC electricity to LED module 10 via lead wire 15.

Drive circuit 80 includes a circuit substrate and a plurality of circuit elements (electronic parts) for turning on LED module 10. Each circuit element is mounted to the circuit substrate.

[Base]

Base 90 receives electricity for causing LED module 10 (LEDs 12) to emit light from a source external to the lamp. Base 90 is, for example, attached to the socket of a lighting fixture. With this, base 90 can receive electricity from the socket of the lighting fixture when illumination light source 100 is turned on. AC electricity is supplied to base 90 from, for example, an AC 100V utility power supply. Base 90 receives the AC electricity from two contact points. The received electricity is input into the electricity input unit of drive circuit 80 via a pair of lead wires (not shown in the drawings).

As is illustrated in FIG. 1, base 90 is a metal cylindrical body having a bottom. Base 90 includes a shell portion whose outer periphery surface includes male screw threads, and an eyelet portion attached to the shell portion via the insulating portion. The outer periphery surface of base 90 is threaded for screwing into the socket of the lighting fixture.

The type of base 90 is not particularly limited to a certain type. In illumination light source 100, a threaded Edison (E-type) base is used. Examples of base 90 include E26, E17, or E16 type bases. It should be noted that base 90 may be a bi-pin base (G, GU, GX, etc.) rather than a threaded base.

[Light-Emitting Apparatus Functionality]

As is illustrated in FIG. 3, with light-emitting apparatus 1, raised portion 21, which is a portion of pedestal 20, is inserted in first through-hole 11*a* of substrate 11. This makes it possible to restrict horizontal movement of substrate 11 with raised portion 21. In other words, the relative positions of pedestal 20, LED module 10 (substrate 11), and optical component 30 can be easily aligned.

Moreover, optical component 30 is not fixed to LED module 10 (substrate 11) and is fastened to pedestal 20. This makes it possible to keep damage to substrate 11 to a minimum, since optical component 30 does not place any load on substrate 11. This in turn makes it possible to use a ceramic substrate as substrate 11, and realize light-emitting apparatus 1 that has superior heat dissipating properties.

In this way, with light-emitting apparatus 1, it is possible to easily align LEDs 12 and optical component 30 without damaging substrate 11 on which LEDs 12 are mounted.

Furthermore, since optical component 30 is disposed in the emission direction of light from LED module 10, even if substrate 11 were to become separated from pedestal 20 due to malfunction or degradation of the adhesive, optical component 30 can keep substrate 11 from falling off.

Moreover, at least a portion of the side surface of raised portion 21 of pedestal 20 has a shape corresponding to the inner surface of first through-hole 11*a* of substrate 11. This makes it possible to further restrict horizontal movement of substrate 11 with raised portion 21, thereby making it even easier to align LEDs 12 and optical component 30.

Moreover, first through-hole 11*a* is formed inside the loop formed by LEDs 12 and sealing member 13. With this, optical component 30 is fixed to pedestal 20 in the region surrounded by the light emitter (LEDs 12 and sealing member 13) of LED module 10. As such, light emitting from the outer perimeter of the light emitter of LED module 10 can be kept from being blocked by obstructions.

When a fastener that fixes optical component 30 and pedestal 20 is present outside the loop of the light emitter of LED module 10, this fastener blocks light emitting from LED module 10. This results in a reduction of the light distribution characteristic. Moreover, when a fastener that does not contribute to the control of the light distribution is present outside the loop of the light emitter of LED module 10, the light from LED module 10 is scattered by the fastener resulting in uneven luminance.

In contrast, when optical component 30 is fixed to pedestal 20 with fastener 40 inside the loop of the light emitter (LEDs 12*s* and sealing member 13) of LED module 10, the above-described reduction of the light distribution characteristic and uneven luminance does not occur. As such, it is possible to achieve an even light distribution around the entire LED module 10.

Moreover, first through-hole 11*a* of substrate 11 has an oval-shaped (racetrack-shaped) opening. Raised portion 21 mates with first through-hole 11*a*. With this, horizontal movement of substrate 11 can be restricted and alignment of substrate 11 and pedestal 20 can be achieved absolutely. This also makes it possible to keep substrate 11 from rotating. Consequently, LEDs 12 and optical component 30 can easily and accurately be aligned.

Moreover, in a rotation preventing structure (first through-hole 11*a*, raised portion 21), even if optical component 30 (lens portion 31) is a rotationally symmetric optical component, fixing optical component 30 in a position away from the center of pedestal 20 and substrate 11 is particularly beneficial. It should be noted that the following variations also have the same advantageous effects as the rotation preventing structure.

Figure 5:
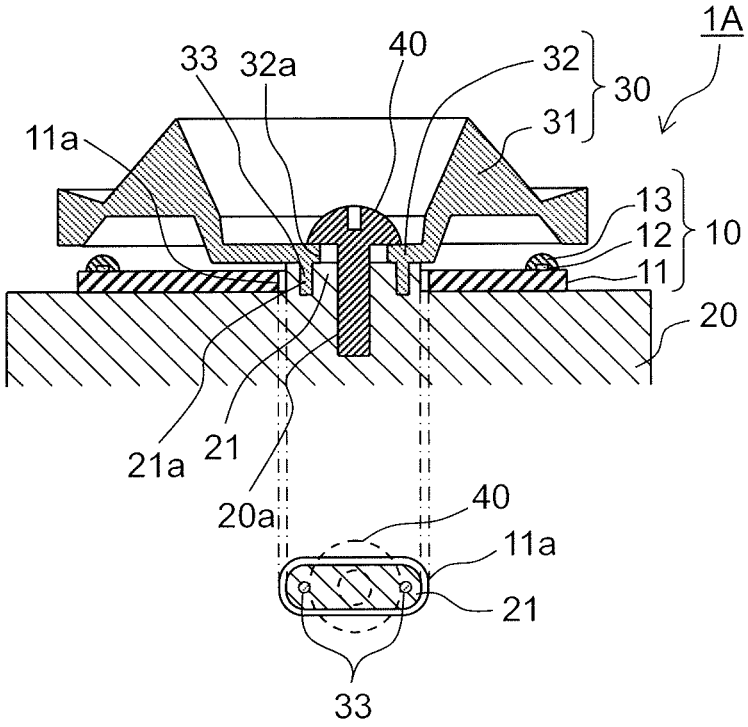
FIG. 5 is a cross sectional view of a light-emitting apparatus according to a first variation of the embodiment.

Next, light-emitting apparatus 1A according to a first variation of the embodiment will be described with reference to FIG. 5. FIG. 5 is a cross sectional view of light-emitting apparatus 1A. It should be noted that it is possible to substitute light-emitting apparatus 1 for light-emitting apparatus 1A in illumination light source 100.

Light-emitting apparatus 1A differs from light-emitting apparatus 1 in that pedestal 20 includes a plurality of recesses 21*a* and optical component 30 includes a plurality of protrusions 33.

The plurality of recesses 21*a* are provided in raised portion 21 of pedestal 20. The plurality of protrusions 33 are provided on attachment portion 32. More specifically, the plurality of protrusions 33 are formed so as to protrude from the bottom surface of attachment portion 32 toward pedestal 20.

Each of the plurality of recesses 21*a* corresponds to each of the plurality of protrusions 33, and protrusions 33 are inserted in recesses 21*a*. With light-emitting apparatus 1A, two protrusions 33 and two recesses 21*a* are provided, and recesses 21*a* and protrusions 33 mate together.

With light-emitting apparatus 1A, it is possible to achieve the same advantageous effects as light-emitting apparatus 1.

Furthermore, optical component 30 is placed on pedestal 20 such that the plurality of protrusions 33 are inserted into the plurality of the recesses 21*a* in pedestal 20. With this, alignment of optical component 30 and pedestal 20 can be achieved absolutely. Additionally, this also makes it possible to keep optical component 30 from rotating with respect to pedestal 20.

It should be noted that in light-emitting apparatus 1A, two protrusions 33 and two recesses 21*a* (rotation preventing structure) are provided, but this example is not limiting; three or more of each may be provided. Alternatively, even if a single protrusion 33 and a single recess 21*a* are provided, so long as the top of protrusion 33 and the opening of recess 21*a* are non-circular in shape, it is possible to align optical component 30 and pedestal 20 absolutely. This also makes it possible to keep optical component 30 from rotating. In this case, optical component 30 and pedestal 20 may be attached together by mating protrusion 33 and recess 21*a*. Conceivable non-circular shapes include, for example, polygonal shapes such as a rectangle, an elliptical shape, or a racetrack shape.

Figure 6:
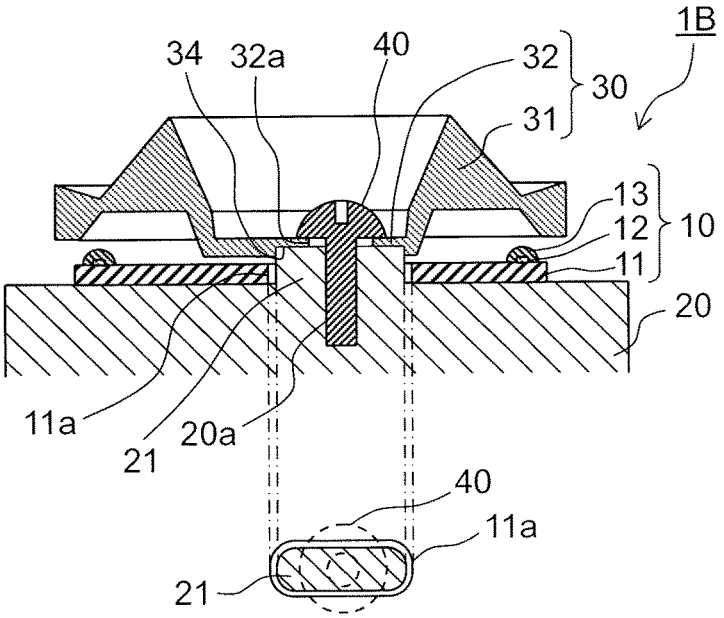
FIG. 6 is a cross sectional view of a light-emitting apparatus according to a second variation of the embodiment.

Next, light-emitting apparatus 1B according to a second variation of the embodiment will be described with reference to FIG. 6. FIG. 6 is a cross sectional view of light-emitting apparatus 1B. It should be noted that it is possible to substitute light-emitting apparatus 1 for light-emitting apparatus 1B in illumination light source 100.

As is illustrated in FIG. 6, light-emitting apparatus 1B differs from light-emitting apparatus 1 in that optical component 30 includes recess 34.

Recess 34 in optical component 30 is formed by depressing the portion of the surface of attachment portion 32 that opposes pedestal 20. Recess 34 mates with raised portion 21 of pedestal 20. More specifically, recess 34 is shaped so as to cover raised portion 21 and the upper portion of raised portion 21. Recess 34 has, for example, an oval-shaped (racetrack-shaped) opening.

With light-emitting apparatus 1B, it is possible to achieve the same advantageous effects as light-emitting apparatus 1.

Furthermore, optical component 30 is connected to pedestal 20 such that recess 34 mates with raised portion 21. With this, alignment of optical component 30 and pedestal 20 can be achieved absolutely.

Furthermore, both the opening of recess 34 and the top of raised portion 21 are oval-shaped (racetrack-shaped). This also makes it possible to keep optical component 30 from rotating with respect to pedestal 20. It should be noted that recess 34 and raised portion 21 (rotation preventing structure) may have an elongated shape such as an elliptical or rectangular shape in a plan view. Alternatively, the shape is not limited to an elongated shape; any shape is sufficient so long as the shape is non-circular, such as a polygonal shape. Forming the opening of recess 34 and the top of raised portion 21 to have non-circular shapes makes it possible to keep optical component 30 from rotating.

Figure 7:
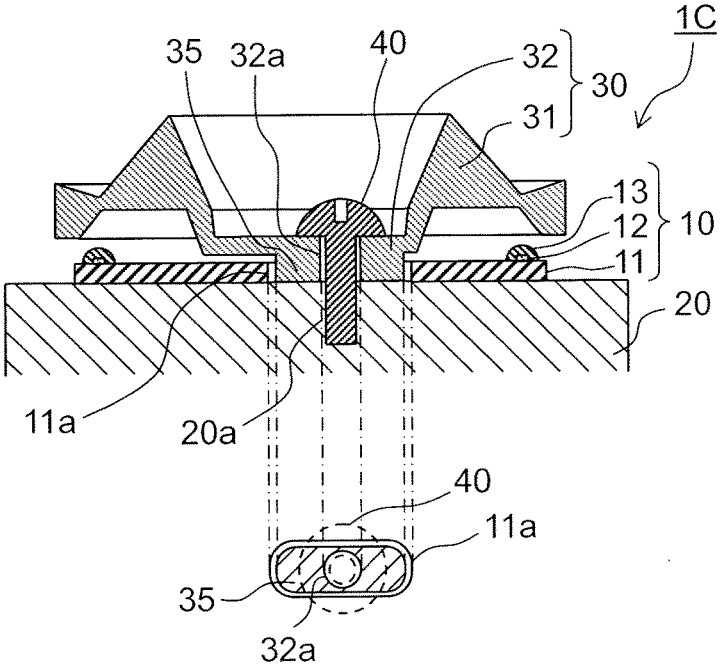
FIG. 7 is a cross sectional view of a light-emitting apparatus according to a third variation of the embodiment.

Next, light-emitting apparatus 1C according to a third variation of the embodiment will be described with reference to FIG. 7. FIG. 7 is a cross sectional view of light-emitting apparatus 1C. It should be noted that it is possible to substitute light-emitting apparatus 1 for light-emitting apparatus 1C in illumination light source 100.

As is illustrated in FIG. 7, light-emitting apparatus 1C differs from light-emitting apparatus 1 in regard to the structures of pedestal 20 and optical component 30.

More specifically, with light-emitting apparatus 1, pedestal 20 includes raised portion 21 and the back surface of attachment portion 32 of optical component 30 is planar. Conversely, with light-emitting apparatus 1C, optical component 30 includes raised portion 35 and the top surface of pedestal 20 is planar. In other words, pedestal 20 of light-emitting apparatus 1C does not include a raised portion.

Raised portion 35 is a portion of optical component 30, and protrudes from attachment portion 32 toward pedestal 20. Raised portion 35 is integrally formed with lens portion 31 and attachment portion 32.

Raised portion 35 is inserted in first through-hole 11*a* of substrate 11. The height of raised portion 35 measured from the back surface of attachment portion 32 is greater than the thickness of substrate 11. With this, when raised portion 35 is inserted in first through-hole 11*a* and the top portion of raised portion 35 is in contact with the top surface of pedestal 20, it is possible to provide a gap between the surface of substrate 11 and optical component 30. As such, it is possible to achieve a configuration in which optical component 30 (attachment portion 32) and substrate 11 are not in contact.

Moreover, at least a portion of the side surface of raised portion 35 has a shape corresponding to the inner surface of first through-hole 11*a*. As is illustrated in FIG. 7, the shape of the top of raised portion 35 is substantially identical to the shape of the opening of first through-hole 11*a*. That is to say, the shape of the side surface of raised portion 35 and the shape of the inner surface of first through-hole 11*a* are substantially identical. In other words, raised portion 35 mates with first through-hole 11*a*. More specifically, raised portion 35 has an oval-shaped (racetrack-shaped) top. It should be noted that even when raised portion 35 and first through-hole 11*a* are mated together, a slight gap may be present between raised portion 35 and first through-hole 11*a*.

In optical component 30, insertion hole 32*a* through which fastener 40 is inserted is provided in raised portion 35. In other words, fastener 40 passes through raised portion 35 and insertion hole 32*a* and is inserted in fastening hole 20*a* of pedestal 20.

With light-emitting apparatus 1C, raised portion 35 of optical component 30 is inserted in first through-hole 11*a* of substrate 11. This makes it possible to restrict horizontal movement of substrate 11 with raised portion 35, thereby making it possible to align LED module 10 (substrate 11). Consequently, LEDs 12 and optical component 30 can easily be aligned.

Moreover, optical component 30 is not fixed to LED module 10 (substrate 11) and is fastened to pedestal 20 with fastener 40. This makes it possible to keep damage to substrate 11 to a minimum, since optical component 30 does not place any load on substrate 11.

In this way, with light-emitting apparatus 1C, it is possible to easily align LEDs 12 and optical component 30 without damaging substrate 11 on which LEDs 12 are mounted.

Moreover, same as with light-emitting apparatus 1, optical component 30 can keep substrate 11 from falling off.

Moreover, at least a portion of the side surface of raised portion 35 of optical component 30 has a shape corresponding to the inner surface of first through-hole 11*a* of substrate 11. This makes it possible to restrict horizontal movement of substrate 11 with raised portion 35. Consequently, LEDs 12 and optical component 30 can be aligned even more easily.

Moreover, first through-hole 11*a* is formed inside the loop formed by LEDs 12 and sealing member 13. With this, optical component 30 is fixed to pedestal 20 in the region surrounded by the light emitter (LEDs 12 and sealing member 13) of LED module 10. As such, light emitting from the outer perimeter of the light emitter of LED module 10 can be kept from being blocked by obstructions. As such, it is possible to achieve an even light distribution around the entire LED module 10.

Moreover, first through-hole 11*a* of substrate 11 has an oval-shaped opening. Raised portion 35 mates with first through-hole 11*a*. With this, horizontal movement of substrate 11 can be restricted and alignment of substrate 11 and optical component 30 can be achieved absolutely. This also makes it possible to prevent rotation of optical component 30 with respect to substrate 11 and pedestal 20.

It should be noted that the shape of raised portion 35 and first through-hole 11*a* (rotation preventing structure) in a plan view is a racetrack shape, but so long as the shape is a non-circular shape such as a polygonal or elliptical shape, it is possible to prevent rotation of optical component 30.

Moreover, in contrast with the light-emitting apparatus 1, in light-emitting apparatus 1C, the raised portion is provided not on metal pedestal 20 but on the resin optical component 30. With this, processing costs associated with metal pedestal 20 can be reduced. It should be noted that since optical component 30 is formed by resin molding, additional processing costs associated with adding raised portion 35 to optical component 30 are virtually nonexistent.

Figure 8:
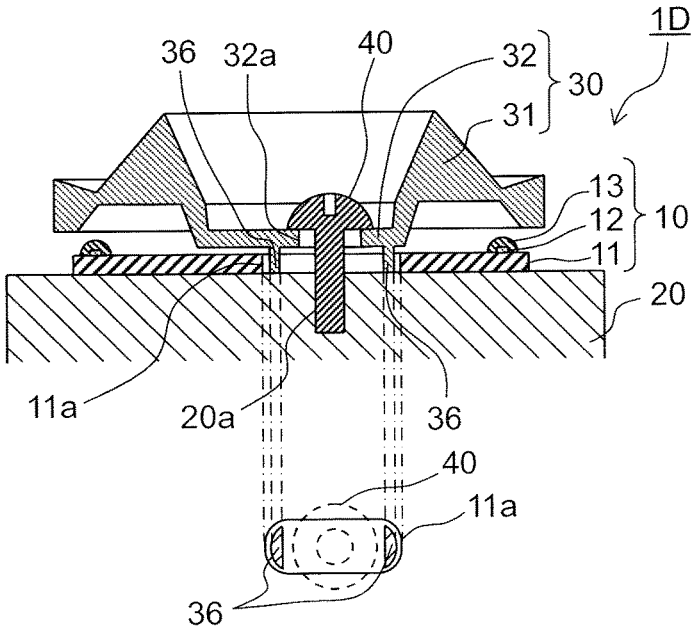
FIG. 8 is a cross sectional view of a light-emitting apparatus according to a fourth variation of the embodiment.

Next, light-emitting apparatus 1D according to a fourth variation of the embodiment will be described with reference to FIG. 8. FIG. 8 is a cross sectional view of light-emitting apparatus 1D. It should be noted that it is possible to substitute light-emitting apparatus 1 for light-emitting apparatus 1D in illumination light source 100.

As is illustrated in FIG. 8, light-emitting apparatus 1D differs from light-emitting apparatus 1C in that optical component 30 includes a pair of protrusions 36. That is to say, raised portion 35 in light-emitting apparatus 1C is embodied as the pair of protrusions 36.

The pair of protrusions 36 are provided on attachment portion 32. More specifically, the pair of protrusions 36 protrude from the bottom surface of attachment portion 32 toward pedestal 20. The pair of protrusions 36 are integrally formed with lens portion 31 and attachment portion 32 from resin.

The pair of protrusions 36 are formed to correspond with first through-hole 11*a* of substrate 11. Moreover, at least a portion of the side surface of the pair of protrusions 36 has a shape corresponding to the inner surface first through-hole 11*a*, such as a circular arc.

Moreover, the pair of protrusions 36 are provided at the longitudinal ends of the oval-shaped first through-hole 11*a*, and fastener 40 passes between the pair of protrusions 36.

With light-emitting apparatus 1D, it is possible to achieve the same advantageous effects as light-emitting apparatus 1C.

Furthermore, the pair of protrusions 36 are inserted in the single first through-hole 11*a*. In other words, a space is present between the pair of protrusions 36. With this, compared to raised portion 35 of light-emitting apparatus 1C, the pair of protrusions 36 are greatly elastic. As such, it is possible to improve the reliability of the fixing of optical component 30 with this spring effect.

In other words, the pair of protrusions 36 have the same function as a spring lock washer, and keep fastener 40 (screw) from loosening from vibration. Moreover, the elasticity of the pair of protrusions 36 can absorb the excessive stress resulting from over tightening fastener 40. This makes it possible to reduce, for example, the occurrence of optical component 30 breaking.

Moreover, providing two protrusions 36 prevents rotation of optical component 30, but as the rotation preventing structure, the number of protrusions 36 is not limited to two; three or more protrusions 36 may be provided. Even if a single protrusion 36 is provided, so long as the shape of the top of protrusion 36 is non-circular and the outer surface of protrusion 36 is in contact with the inner surface of first through-hole 11*a* in multiple places, rotation of optical component 30 can be prevented. In this case, conceivable non-circular shapes include, for example, polygonal shapes such as a rectangle, an elliptical shape, or a racetrack shape.

Figure 9:
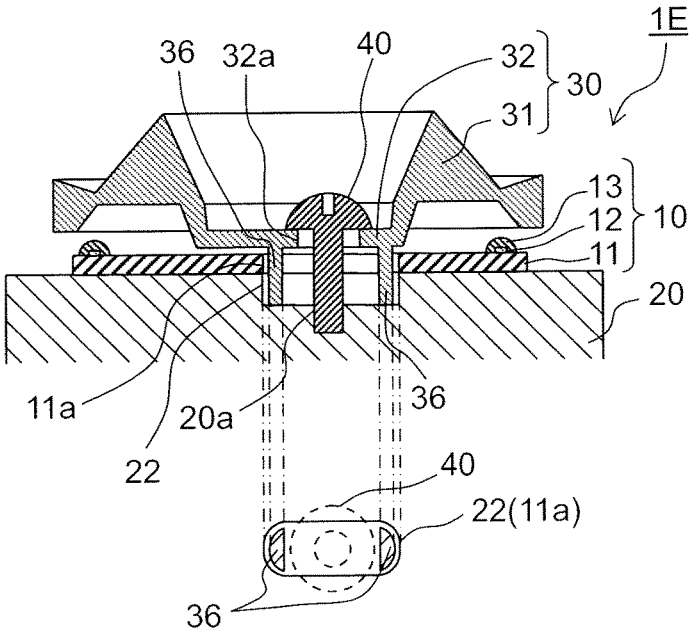
FIG. 9 is a cross sectional view of a light-emitting apparatus according to a fifth variation of the embodiment.

Next, light-emitting apparatus 1E according to a fifth variation of the embodiment will be described with reference to FIG. 9. FIG. 9 is a cross sectional view of light-emitting apparatus 1E. It should be noted that it is possible to substitute light-emitting apparatus 1 for light-emitting apparatus 1E in the illumination light source 100.

As is illustrated in FIG. 9, light-emitting apparatus 1E differs from light-emitting apparatus 1D in that pedestal 20 includes recess 22 and the pair of protrusions 36 are longer.

Recess 22 is formed to correspond with first through-hole 11*a* of substrate 11. Same as the shape of the opening of first through-hole 11*a*, recess 22 has an oval-shaped opening. Consequently, a portion of the inner surface of recess 22 has the same shape as a portion of the side surfaces of the pair of protrusions 36, such as a circular arc.

The pair of protrusions 36 are disposed in recess 22. In other words, the pair of protrusions 36 pass through first through-hole 11*a* of substrate 11, and the top portions of the pair of protrusions 36 are in contact with the bottom surface of recess 22. The pair of protrusions 36 are provided at the longitudinal ends of the oval-shaped recess 22. It should be noted that fastener 40 passes between the pair of protrusions 36, same as with light-emitting apparatus 1D.

With light-emitting apparatus 1E, it is possible to achieve the same advantageous effects as light-emitting apparatus 1C and light-emitting apparatus 1D.

Furthermore, the pair of protrusions 36 of optical component 30 are inserted in first through-hole 11*a* and in recess 22 of pedestal 20. With this, alignment of optical component 30, substrate 11, and pedestal 20 can be achieved absolutely.

Figure 10:
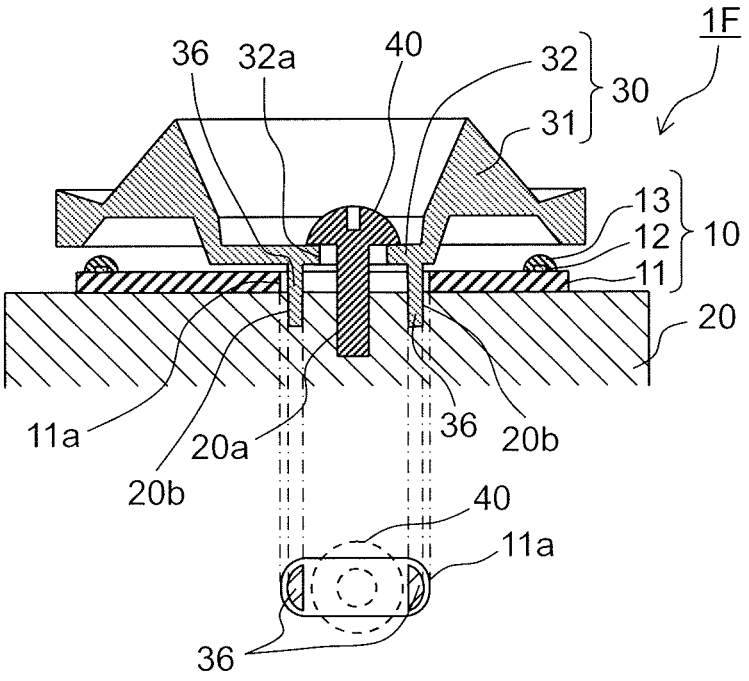
FIG. 10 is a cross sectional view of a light-emitting apparatus according to a sixth variation of the embodiment.

It should be noted that recess 22 of pedestal 20 has the same shape as first through-hole 11*a*, but the shape is not limited to this example. For example, such as is the case with light-emitting apparatus 1F according to variation 6 of the embodiment shown in FIG. 10, a pair of recesses 20*b*, which correspond to the pair of protrusions 36, may be formed in pedestal 20. In this case, although the spring effect of the pair of protrusions 36 decreases, the accuracy of the absolute alignment of optical component 30, substrate 11, and pedestal 20 increases beyond that of light-emitting apparatus 1E in FIG. 9.

Moreover, even with light-emitting apparatus 1E, for the same reasons as light-emitting apparatus 1D, the number of protrusions 36 is not limited to two; three or more may be provided, or one may be provided.

(Lighting Apparatus)

Figure 11:
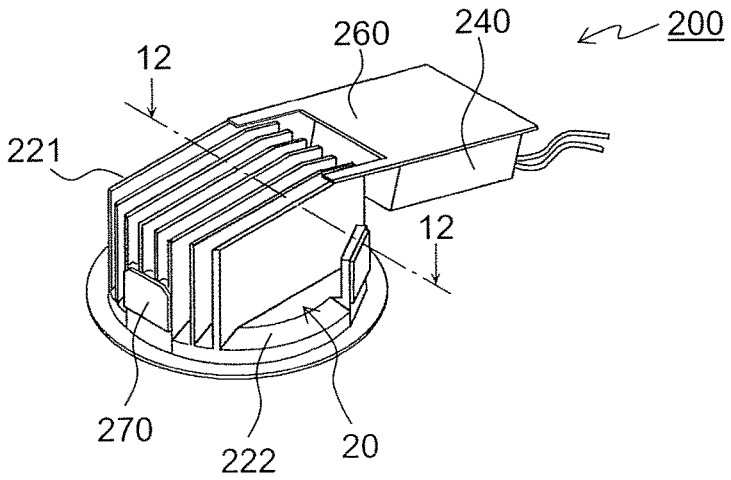
FIG. 11 is a perspective view of a lighting apparatus according to the embodiment.
Figure 12:
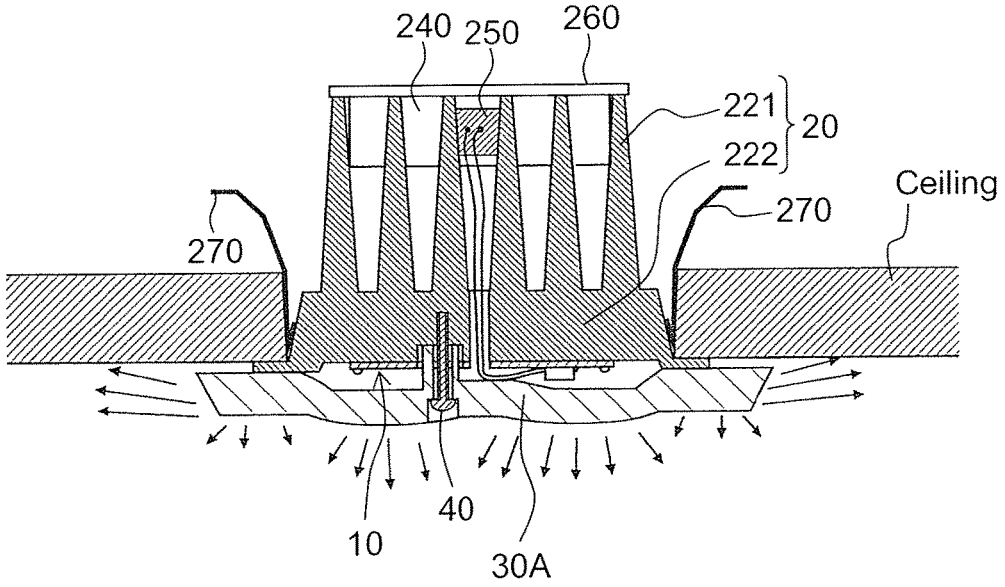
FIG. 12 is a cross sectional view of the lighting apparatus taken at line 12-12 in FIG. 11.

Next, lighting apparatus 200 according to the embodiment will be described with reference to FIG. 11 and FIG. 12. FIG. 11 is a perspective view of lighting apparatus 200. FIG. 12 is a cross sectional view of lighting apparatus 200 taken at line 12-12 in FIG. 11.

As is illustrated in FIG. 11 and FIG. 12, lighting apparatus 200 is a recessed lighting apparatus such as a recessed light that is recessed in the ceiling of a home, for example, and shines light downward (toward the floor or a wall, for example).

Lighting apparatus 200 includes a light-emitting apparatus including LED module 10, pedestal 20, optical component 30A, and fastener 40. Furthermore, lighting apparatus 200 includes: power source apparatus 240 attached to pedestal 20; terminal base 250; attachment plate 260; and fastening spring 270.

Pedestal 20 is the main body of lighting apparatus 200, and functions as an attachment base for attaching LED module 10, as well as a heat sink for dissipating heat generated by LED module 10. Pedestal 20 can be made from metal, and is, for example, an aluminum die-cast.

The top portion of pedestal 20 (portion facing the ceiling) includes a plurality of heat dissipation fins 221 that protrude upward. This makes it possible to efficiently dissipate the heat generated by LED module 10.

Moreover, pedestal 20 includes attachment portion 222 for attaching and fixing LED module 10. LED module 10 is placed on the surface of attachment portion 222.

Optical component 30A is disposed in the emission direction of light from LED module 10 so as to cover LED module 10. Optical component 30A has a flat disk shape, and is a light distribution controlling lens, same as optical component 30 in light-emitting apparatus 1 illustrated in FIG. 1. It should be noted that optical component 30A also functions as a cover for lighting apparatus 200, and also includes the function of protecting LED module 10.

It should be noted that optical component 30A may be provided with a light diffusing function to prevent uneven luminance. For example, surface texturing may be performed on the outer surface of optical component 30A to roughen the surface, a light diffusing film including a light diffusing substance such as silica may be formed, or a light diffusing substance may be mixed in with optical component 30A.

Power source apparatus (power circuit) 240 receives electricity from a utility power supply (for example, AC 100V) and generates electricity for causing LED module 10 to emit light. Moreover, terminal base 250 links power source apparatus 240 and LED module 10, and supplies electricity from power source apparatus 240 to LED module 10. It should be noted that power source apparatus 240 is fixed to attachment plate 260.

Moreover, the outer perimeter wall of pedestal 20 includes fastening spring (attachment spring) 270. Fastening spring 270 fixes pedestal 20 to the ceiling. Fastening spring 270 is formed, for example, by bending one longitudinal end of a rectangular stainless steel plate into a V shape. A plurality of fastening springs 270 (for example, three) are provided along the perimeter of pedestal 20, spaced apart from each other at predetermined distances.

It is possible to achieve the same advantageous effects as illumination light source 100 with lighting apparatus 200.

(Other Variations)

Hereinbefore, the light-emitting apparatus, illumination light source, and lighting apparatus according to the present disclosure have been described based on an embodiment and variations of the embodiment. The present disclosure is not limited to this embodiment and the variations of this embodiment.

Figure 13:
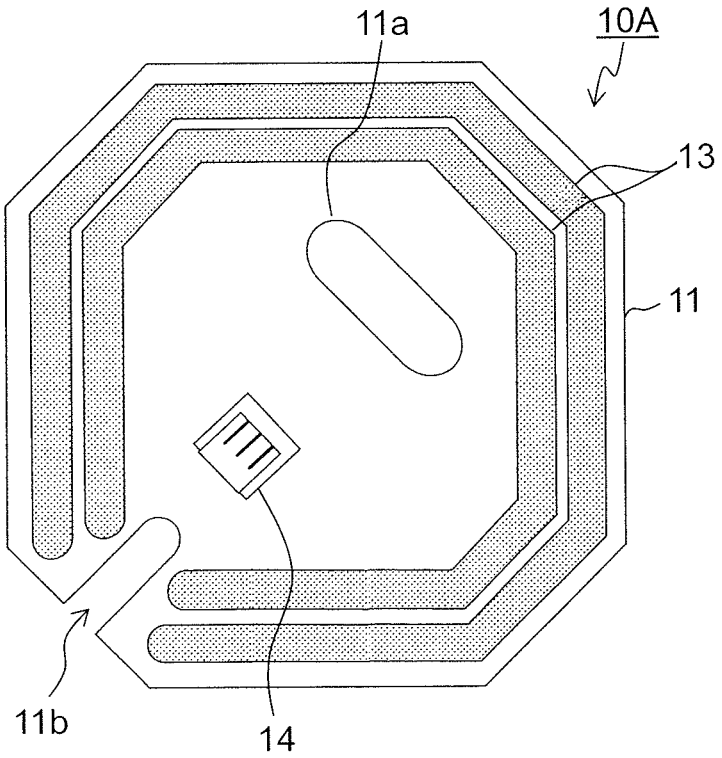
FIG. 13 is a plan view of an LED module according to another variation.

For example, in the above embodiment and variations of the embodiment, with LED module 10, the line of LEDs 12 is formed in a single loop shape and sealing member 13 (sealing line) is also formed in a single loop shape, but like LED module 10A illustrated in FIG. 13, LEDs 12 may be formed in two lines forming two loops and sealing member 13 (sealing line) may also be formed in two loop shapes.

Moreover, in the above embodiment and variations of the embodiment, LED module 10 is a COB style module in which LED chips are directly mounted as light-emitting elements on the substrate 11, but the configuration of LED module 10 is not limited to this example. For example, a package-type LED element (SMD-type LED element) including a plastic container having a recess (cavity), an LED chip mounted in the recess, and a sealing member (phosphor-containing resin) sealing the recess, may be used as the light-emitting element, and an SMD-type light-emitting apparatus (LED module) configured by mounting a plurality of these LED elements on the substrate 11 may be used.

Moreover, in the above embodiment and variations of the embodiment, the LED module emits a white light using a blue LED chip and a yellow phosphor, but this configuration is not limiting. For example, in order to increase color rendering properties, in addition to the yellow phosphor, a red phosphor or a green phosphor may be mixed in. Moreover, a configuration is possible in which, without using a yellow phosphor, a phosphor-containing resin which includes red and green phosphors is used and white light is radiated when used in combination with a blue LED chip.

Moreover, in the above embodiment and variations of the embodiment, the LED chip may be configured using an LED chip which emits light of a color other than blue. For example, when an LED chip which emits ultra-violet rays is used, a combination of phosphor particles which respectively emit the three primary colors (red, green and blue) can be used as the phosphor (phosphor particles). Furthermore, wavelength-transforming materials other than phosphor particles may be used. For example, materials including a substance which absorbs a certain wavelength of light and emits light of a different wavelength, such as semiconductors, metal complexes, organic dyes, and pigments, may be used.

Moreover, in the above embodiment and variations of the embodiment, the light-emitting element is exemplified by an LED, but an semiconductor light-emitting element such as a semiconductor laser, or a solid-state light-emitting element, such as an organic electro luminescence (EL) element or an inorganic EL element, may be used.

Moreover, in the above embodiment and variations of the embodiment, examples of applications for the light-emitting apparatus include a bulb-shaped lamp and a recessed lighting apparatus, but these examples are not limiting. For example, the light-emitting apparatus may be applied as a low-profile lighting apparatus (LED unit) including a base structure such as a GX53 base or a GH76p base, or a different type of lighting apparatus.

Additionally, various modifications to the embodiment and variations of the embodiment conceivable by those skilled in the art as well as embodiments resulting from arbitrary combinations of constituent elements of the embodiment and variations of the embodiment which do not depart from the essence of the present disclosure are intended to be included the present disclosure.

What is claimed is:

1. A light-emitting apparatus comprising:

a pedestal;

a substrate disposed on the pedestal and having a through-hole;

a plurality of light-emitting elements mounted on the substrate;

an optical component disposed in an emission direction of light from the plurality of light-emitting elements; and a fastener passing through the through-hole and fastening the pedestal and the optical component together, wherein:

at least one of a portion of the pedestal and a portion of the optical component includes a raised portion inserted in the through-hole, at least a portion of a side surface of the raised portion has a shape corresponding to an inner side surface of the through-hole, the through-hole has a rounded rectangular-shaped opening, the through-hole is in a position away from the center of the substrate, and the raised portion is in a position away from the center of the pedestal.

2. The light-emitting apparatus according to claim 1, wherein the plurality of light-emitting elements are mounted in a loop around an outer perimeter of the substrate, and the through-hole is formed inside the loop of the plurality of light-emitting elements.

3. The light-emitting apparatus according to claim 1, wherein the at least a portion of a side surface of the raised portion having a shape corresponding to an inner side surface is exposed to the through-hole of the substrate, and the optical component is placed on the raised portion.

4. The light-emitting apparatus according to claim 3, wherein the raised portion includes a plurality of recesses, and the optical component includes a plurality of protrusions that are inserted respectively into the plurality of recesses.

5. The light-emitting apparatus according to claim 3, wherein the raised portion includes a recess having a non-circular opening, and the optical component includes a protrusion that mates with the recess.

6. The light-emitting apparatus according to claim 3, wherein the optical component has a surface opposing the pedestal and including a recess, and the raised portion mates with the recess.

7. The light-emitting apparatus according to claim 3, wherein the raised portion includes a fastening hole to which the fastener is fastened.

8. The light-emitting apparatus according to claim 3, wherein the raised portion mates with the through-hole.

9. The light-emitting apparatus according to claim 1, wherein the optical component includes a raised portion that is inserted in the through-hole, and the raised portion has a top portion being in contact with the pedestal.

10. The light-emitting apparatus according to claim 9, wherein the raised portion mates with the through-hole.

11. The light-emitting apparatus according to claim 9, wherein the raised portion includes an insertion hole through which the fastener is inserted.

12. The light-emitting apparatus according to claim 9, wherein the raised portion comprises a pair of protrusions.

13. The light-emitting apparatus according to claim 12, wherein the fastener is inserted between the pair of protrusions.

14. The light-emitting apparatus according to claim 9, wherein the top portion of the raised portion has a non-circular shape in a plan view.

15. The light-emitting apparatus according to claim 9, wherein the pedestal includes a recess in which the raised portion is disposed.

16. The light-emitting apparatus according to claim 14, wherein at least a portion of a side surface of the raised portion has a shape corresponding to a side surface of the recess.

17. The light-emitting apparatus according to claim 1, wherein a gap is provided between opposing surfaces of the optical component and the substrate.

18. An illumination light source comprising:

the light-emitting apparatus according to claim 1;

a tubular housing having a first end provided with the light-emitting apparatus;

a hollow globe that covers the light-emitting apparatus and closes the first end of the tubular housing;

a drive circuit housed in the housing; and a base provided at a second end of the tubular housing.

19. A lighting apparatus comprising:

the light-emitting apparatus according to claim 1; and a power source apparatus attached to the pedestal of the light-emitting apparatus.

* * * * *